US005295735A

United States Patent [19]

Cobbs et al.

[11] Patent Number: 5,295,735

[45] Date of Patent: Mar. 22, 1994

[54] ROCK SAW

[76] Inventors: David C. Cobbs, 669 E. 139 Pl., Glenpool, Okla. 74033; James H. Cobbs, 5350 E. 46th St., Tulsa, Okla. 74135

[21] Appl. No.: 896,203

[22] Filed: Jun. 10, 1992

[51] Int. Cl.[5] ..... E21B 10/12; E21B 10/16

[52] U.S. Cl. ..... 299/86; 37/189; 175/373

[58] Field of Search ..... 299/40, 86, 83, 84, 299/85, 88, 89; 37/189, 91, 191 A, DIG. 16; 175/338, 373, 374

[56] References Cited

U.S. PATENT DOCUMENTS

| | | | |
|---|---|---|---|
| 254,520 | 3/1882 | Warren . | |
| 1,590,340 | 6/1926 | York . | |
| 1,604,388 | 10/1926 | Calvin . | |
| 1,824,329 | 9/1931 | Childs . | |
| 2,107,626 | 2/1938 | Catland . | |
| 2,261,501 | 11/1941 | Lore . | |
| 2,597,669 | 5/1952 | Pilon et al. . | |
| 2,742,439 | 4/1956 | Hallett . | |
| 3,064,958 | 11/1962 | Osgood . | |
| 3,190,367 | 6/1965 | Christensen | 175/102 |
| 3,216,513 | 11/1965 | Robbins et al. | 175/227 |
| 3,358,782 | 12/1967 | Bechem | 175/344 |
| 3,486,794 | 12/1969 | Tabor | 299/33 |
| 3,612,197 | 10/1971 | Motoyama | 175/364 |
| 3,705,635 | 12/1972 | Conn | 175/364 |
| 3,705,750 | 12/1972 | Crow | 308/8.2 |
| 3,848,930 | 11/1974 | LeBegue | 299/76 |
| 3,858,667 | 1/1975 | Goodfellow | 175/53 |
| 4,035,024 | 7/1977 | Fink | 299/86 X |
| 4,548,442 | 10/1985 | Sugden et al. | 299/31 X |
| 4,596,295 | 6/1986 | Bengtsson | 175/361 |
| 4,647,112 | 3/1987 | Demoulin et al. | 299/81 |
| 4,907,664 | 3/1990 | Cobbs et al. | 175/374 |
| 4,953,916 | 9/1990 | Brandl | 299/76 |
| 5,053,071 | 7/1990 | Stötzer et al. | 299/86 X |

FOREIGN PATENT DOCUMENTS

| | | | |
|---|---|---|---|
| 2035416 | 6/1980 | United Kingdom | 175/373 |

*Primary Examiner*—David J. Bagnell
*Attorney, Agent, or Firm*—Head & Johnson

[57] ABSTRACT

A device for cutting trenches in hard rock. A plurality of disc-like primary cutters are positioned on arms around a frame. The frame rotates about a central shaft and the center shaft is moved along horizontally in the direction the trench is to be cut. Between the primary cutters are reaming cutters. Each primary and each reaming cutter is provided with a plurality of spaced apart indentors secured to the external surface and each indentor has an end point and being adaptable to penetrate the rock face upon the application of working force a distance "P" and wherein the indentor end points are spaced a distance not greater then 7P apart.

15 Claims, 5 Drawing Sheets

ROCK SAW

Field of Invention

This invention relates to the cutting of trenches in rock and especially in hard rock.

Background of the Invention

The cutting of trenches and rock is an important part of much construction, such as the installation of pipelines for water, gas, and electrical conduits. The construction of ditches in soil is well advanced mechanically. However, the technology for cutting trenches in rock and especially hard rock is much more primitive. The current devices for cutting trenches in rock are mainly limited to abrasive wheels or wheels that have mining picks on them. The abrasive wheels are commonly composed of material such as silicon carbide or diamonds impregnated in a metallic matrix. These wheels can cut hard rock but are slow and subject to high wear and breakage rates. The mining picks mounted on a wheel can cut rock at a high speed, but because they are drag bits they are limited to soft rock.

It is therefore seen that there is a need for an improved apparatus for cutting trenches in hard rock. Such a device is disclosed in this application.

Summary of the Invention

A unique feature of this disclosure is the method used to bring the teeth to bear on the rock. The teeth or indentors will be affixed on rotatable wheels that are propelled by a large wheel or chain on a track.

The preferred embodiment includes a frame that can be circular or preferably octagonal. The frame is mounted on a shaft so that the frame can be driven to rotate about the shaft. The shaft can be moved or shoved horizontally. Mounted on the periphery of the frame are a plurality of arms supporting primary cutters each having a geometric center. These primary cutters are free to rotate about a shaft supported by the support arms. Each primary cutter includes a body member having at least two rim-like circumferential levels or portions of different radius with respect to the geometrical center. Each body member is mounted to rotate about a shaft supported by its support arm. Each cutter is provided with a plurality of spaced apart indentors secured to the external surface of each of the rims. Each indentor has an end point and is adaptable to penetrate into the rock face upon the application of a working force a distance of "P" (depth of penetration). The indentor end points are spaced apart a distance not greater than 7 times the depth of penetration (7P). The primary cutters cut a trench of a first width. It is therefore preferred that spaced about the frame between each pair of primary cutters are reaming cutters that widen the trench cut by the primary cutters. In operation, a tractor or other means is used to push the apparatus forward along a horizontal path by applying force to the shaft of the frame. A power take-off is obtained from the tractor and causes the frame to rotate about the frame shaft. This causes rotation of the cutter about its shaft as the teeth contacts the rock and then cuts a trench in the rock. The support means from the driving tractor holds the frame at the desired level with respect to the surface of the rock and applies the proper downward force on the cutters and reamers.

In another embodiment, the primary cutters and the reaming cutters can be mounted on arms that are attached to a chain or a cable that goes around a track that may be rectangular. The chain pulls the arm supports and the cutters around the track.

It is an object of this invention to provide a novel apparatus for cutting trenches in rock and especially in hard rock.

Other object and a better understanding of the invention can be had from the following discussion, taken in conjunction with the attached drawings.

Description Of The Invention

Figure 1:
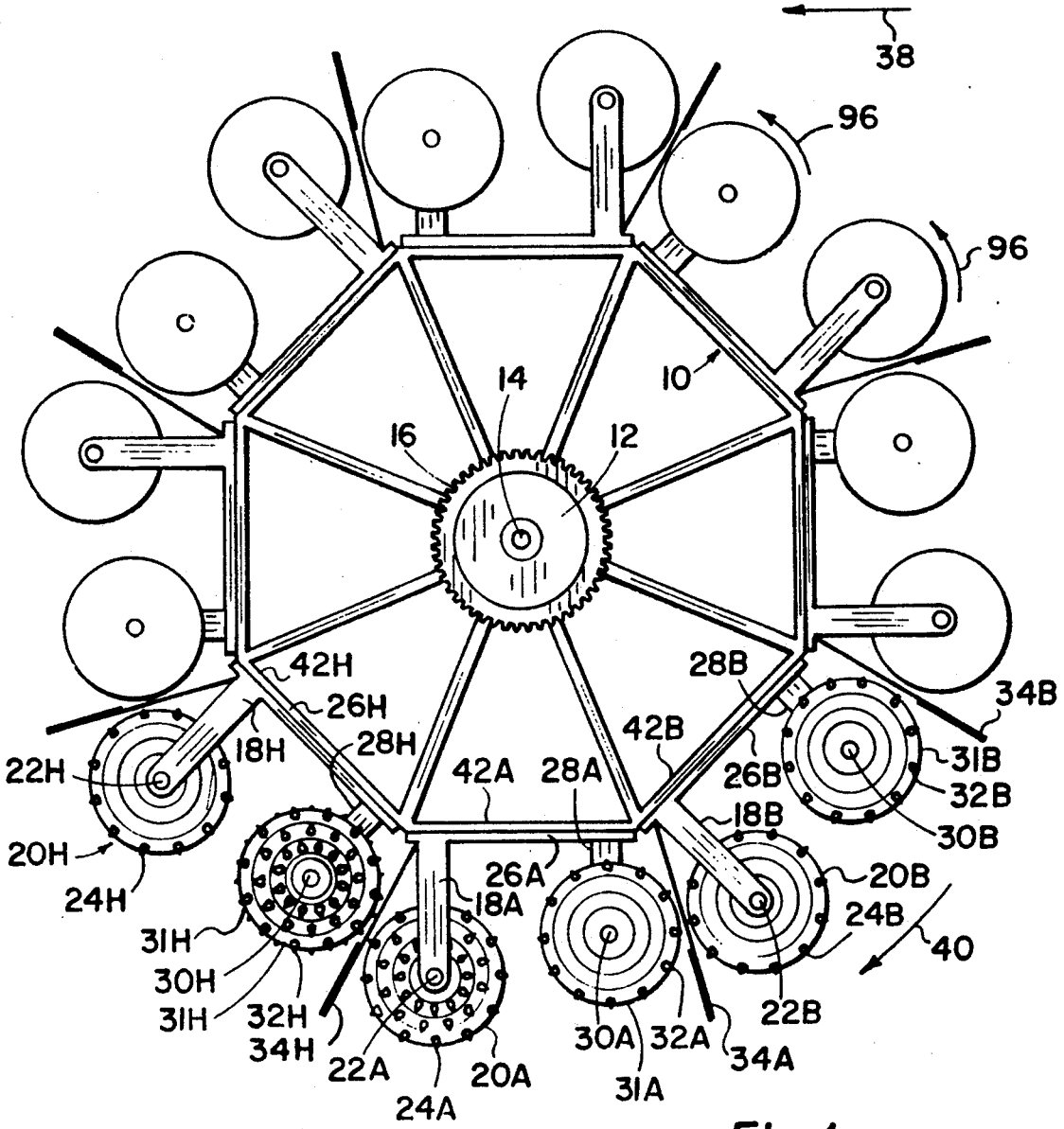
FIG. 1 illustrates the preferred embodiment of this invention in which a plurality of cutters are supported from support arms spaced along the periphery of a rotatable frame.

Attention is first directed to FIG. 1 which shows the preferred embodiment of the invention. Shown thereon is a frame 10 which is rotatably supported on shaft 12 which has a center 14. A drive sprocket 16 is provided so that frame 10 may be rotated about shaft 12. The power source is not shown. Frame 10 has sides 42A through 42N, eight sides are illustrated. However, any number of sides could be provided or the frame could be circular. Supported from each side 42A–42N is a plurality of primary cutters 24A–24N supported by equal length arms 18A–18N from attachment plates 26A–26N. These plates are attached to the sides 42A–42N. Each arm 18A has a corresponding shaft 22A about which cutter 20A may freely rotate. The description of primary cutters is illustrated more clearly in FIGS. 2 and 3 and will be described in detail hereinafter.

Frequently, the width of a trench cut by primary cutters 20A will not be wide enough for the intended use and, therefore, in such cases reaming cutters 31A, 31B and so forth to 31N would be provided. Each such reaming cutter is supported by support arms 28A that has a shaft 30A supporting each reaming cutter for rotation thereabouts similarly as the primary cutters are supported. As shown in FIG. 1, arms 28A are shorter than arms 18A. A reason for this will be explained later, however, it is to be understood that arms 28A may be as long as arms 18A.

Frame 10 is moved to two directions, (1) it is rotated about shaft 12 with center 14 in the direction of arrow 40 as seen in FIG. 1, and (2) frame 10 is moved in the direction of travel as indicated by arrow 38. Shaft 12 may be supported from the front or rear of a tractor by known coupling connectors. The connectors are of such a type as to move shaft 12 and frame 10 in the direction indicated by arrow 38 and to apply whatever downward force is required. Further, drive sprocket 16 is connected to a power take-off of an ancillary tractor. By using known connections, frame 10 is caused to rotate about shaft 12 in the direction of arrow 40.

Figure 1A:
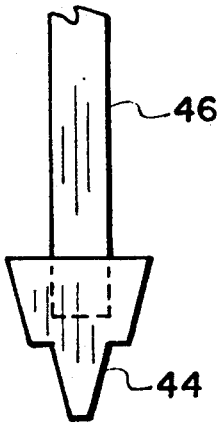
FIG. 1A illustrates in larger detail the scraper of FIG. 1.

As shown in FIG. 1, there are a plurality of scrappers 34A-34N that are spaced behind the reaming cutters. The scrapers are of a character to help remove the cut rock particles from the trench. A suitable scraper is shown in FIG. 1A which has a scrapper point 44 supported by a spring steel support 46. The width of scrapper 44 is about the same as the width of the trench as reamed out by reaming cutters 31A-31N. The point of scraper 44 may be steel or high density polyethylene, and it serves like a broom to sweep out the debris and throw it to the front. If one desires, one can use a small auger, not shown, to throw the debris gathered by the scrapers to one side of the area where the trench is being cut. If desired, one can have scraper buckets and drop the cuttings onto a conveyor, not shown.

In operation, the proper force is applied to shaft 12 to push it in the direction of travel at a selected speed and also to hold the cutters against the rock being cut with a known and selected or determined force. During this time, power is supplied to drive sprocket 16 to cause the frame and supported cutters to rotate about shaft 12 in the direction 40. The individual teeth or indentors 24A penetrate into the rock to cut a narrow width trench. Then as frame 10 is rotated, the reaming cutters extending indentors 31A penetrate the stone and cause it to crater or breakup. The reaming cutters have individual indentors 32A that penetrate into the rock and cause the trench to be widened. Scrappers 34B then proceed to help remove the broken rock and debris from the trench.

Figure 2:
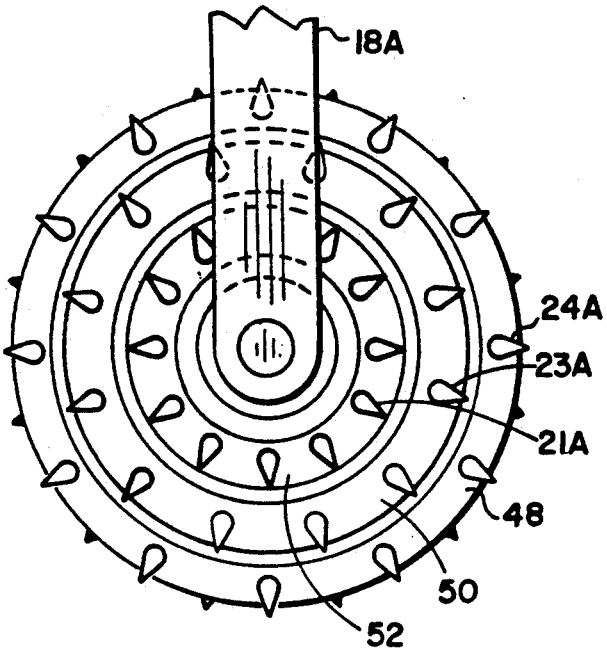
FIG. 2 illustrates the primary cutter of the device of FIG. 1.
Figure 3:
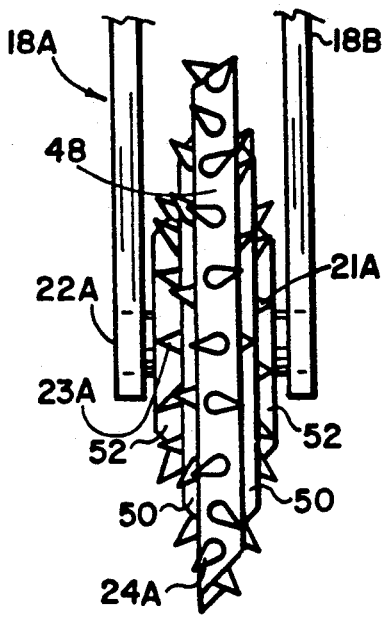
FIG. 3 is an end view of the primary cutter of FIG. 2.

Shown in FIGS. 2 and 3 is a primary cutter of the type illustrated in FIG. 1 having basically an integral disc-like body that includes a large disk-like portion 48. On either side thereof is an intermediate portion 50 that is of a smaller diameter than center portion 48. A still smaller disc-like portion 52 is provided on each side of disc 50. These three portions all have the same axis or center. Each of these disc members has a center that is supported by a common shaft 22A. This can be thought of as a thick pancake, an intermediate and thinner pancake on each side thereof, and a much smaller pancake is on top of the intermediate size pancakes. There is an outer ridge or rim on the largest diameter portion upon which are mounted indentors 24A. As can be seen in FIG. 3, every other one of indentors 24A is pointed in one direction and the in between indentors are pointed in the opposite direction and at a slight angle through the center of rim member 48. Likewise, intermediate portions 50 are provided with a plurality of indentors 23A. The ridge or rim of small portion 52 is likewise provided with a plurality of indentors 21A. The teeth or indentors will bear on the rocks and are spaced such that the craters created by them will be within the critical distance of 7P (where P is the depth of penetration of the point upon application of a working force) to achieve the synergistic effect of indexing between craters. The indentors 24A are each of very tough material, such as tungsten carbide or diamonds and can be retained on the body in a variety of ways. There can be an opening which receives the base of the indentor, such as when the indentor is press-fitted into the opening it is ridgy held there. The preferred angular relationships are 40 to 60 degrees for the tooth included angle; 60 to 90 degrees for the rock slope; 45 to 90 degrees for the attack angle on the rock; and 25 to 45 degrees for the tooth relief angle. The definition of these angles and the theory of indexing between craters are set forth in U.S. Pat. No. 4,907,664 issued Mar. 13, 1990 to James H. Cobbs and David C. Cobbs (present inventors) entitled "Rock Cutting Tool".

Figure 4:
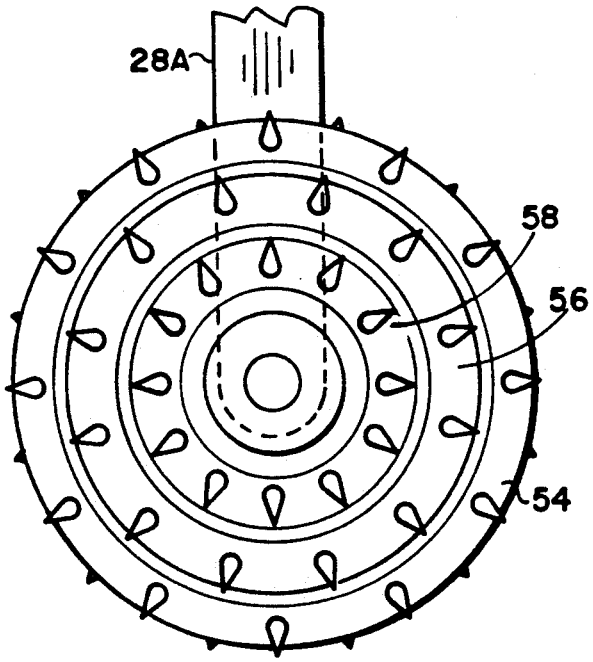
FIG. 4 illustrates a reaming cutter of the device of FIG. 1.
Figure 5:
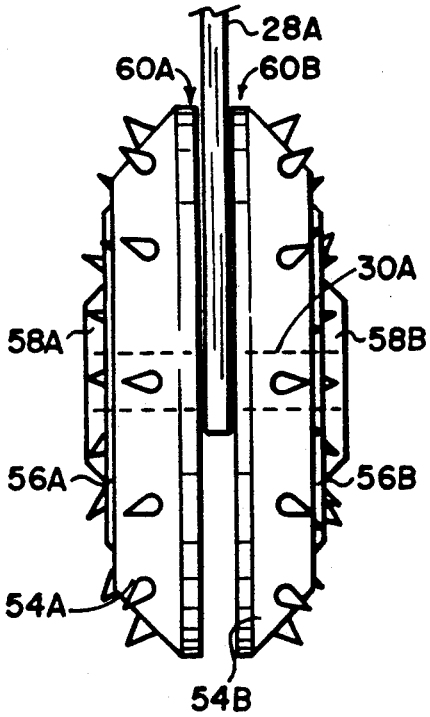
FIG. 5 illustrates an end view of the reaming cutter of FIG. 4.

Attention is next directed to FIGS. 4 and 5 which show an individual reaming cutter. The reaming cutters are constructed similarly to the primary cutters except that the reaming cutters are thicker, i.e. they cut a wider path in the trench. The primary cutters cut a width typically of two to four inches, and the reaming cutters, when followed behind the primary cutters, might widen that trench to a width of four to six inches or more. The actual widths would depend on the exact configuration and size of the cutters.

As shown in FIG. 5, the reaming cutters are made in two parts, each part being identical but separate. There is a major section 54A and 54B on opposite sides. There is one half 60A and the opposite half 60B which are identical mounted on opposite sides of support arms 28A. Each half has a major disc 54A, an intermediate diameter disc 56A, and small disc 58A. All of these discs may be integral into one unit 60A. (Unit 60B is identical but reversed.) Mounted on these discs are a plurality of indentors or teeth. Sections 60A and 60B are considered separately for the requirements of indexing of the indentors. Thus, the indentors on one section 60A should meet the requirements set forth above in regard to the device of FIGS. 2 and 3.

Figure 7:
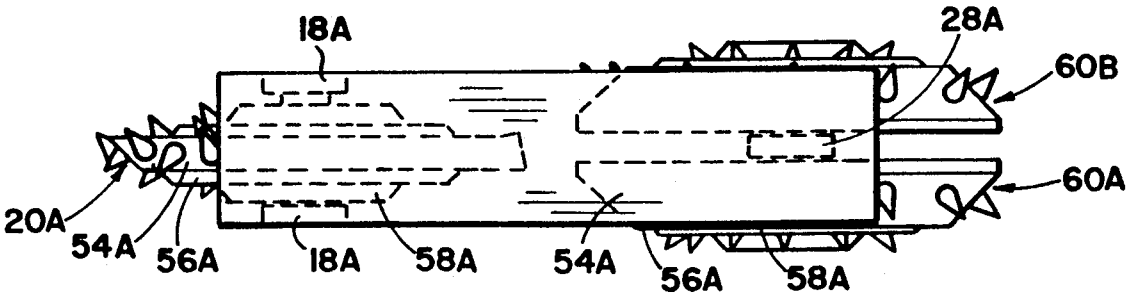
FIG. 7 illustrates a top view of the device of FIG. 6.
Figure 6:
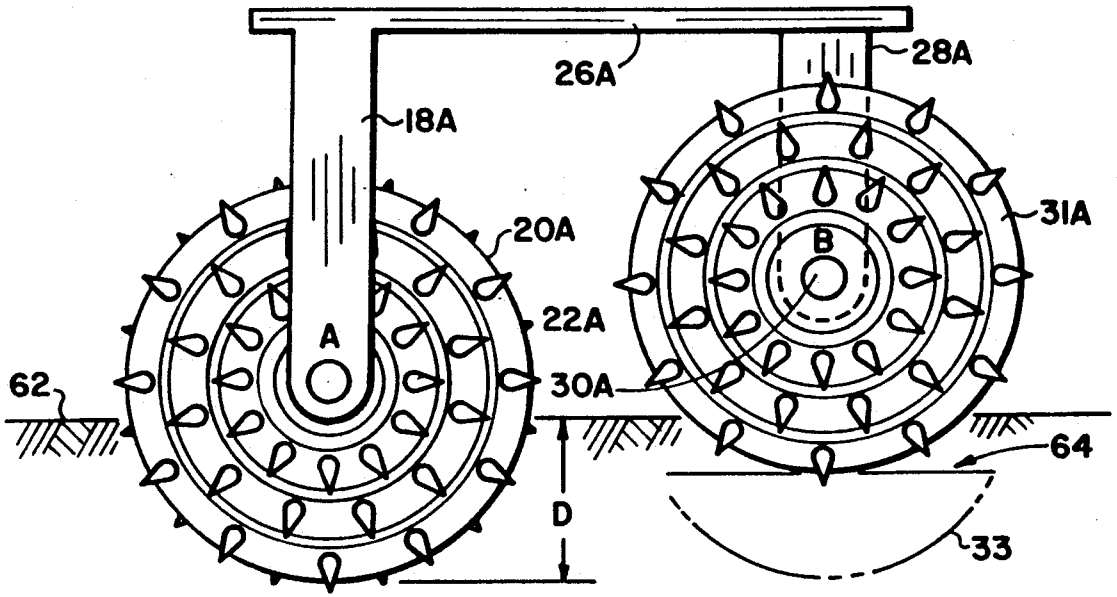
FIG. 6 illustrates a primary cutter and a reaming cutter both supported from an attachment plate.

Attention is next directed to FIGS. 6 and 7 which show a primary cutter 20A and a reaming cutter 31A mounted respectively by arms 18A and 28A from attachment plate 26A. Here, it is shown that the primary cutter has cut down a distance "D" from the rock surface 62. The reaming cutter has cut only to a depth indicated by the line 64. The trench is first cut by the primary cutter to the depth "D" and then the reaming cutter cuts to increase the width. If desired, arm 28A for the reaming cutter can be the same length as arm 18A for the primary cutter, in which case the reaming cutter would be as indicated by the dashed line 33. The bottom of the trench is cut by primary cutter supported by outboard arms 18A which is followed by a two-part reaming cutter supported by internal arms 28A. Each half of the reaming cutter will cut one side of the trench. As soon as the bottom of the trench has been cut by the primary cutters, the sides become independent of each other and indexing of the craters for the reaming cutters is critical to the indentors on side 60A but not to the indentors on the other side 60B. If desired, arm 28A could be as long as arm 18A and then the bottom of the reaming cutter would be as indicated by dashed line 33 which is the same depth as that of the primary cutter. If the depth "D" is not sufficient for the trench for the intended proposes, then multiple passes of the primary cutter and reaming cutter can be made in the same trench to get it to the desired depth. The only primary limiting factor would be the length of arms 18A and 28A which can be made to any practical length. The primary cutter and reaming cutter and attachment plate of FIG. 6 is typically just one of the attachment plates and assembly which are shown in FIG. 1. One rotation of one primary cutter of FIG. 6 would normally not get to the depth "D" required, therefore, the rotation of frame 10 would cause many cuttings and this rotation of frame 10 would be coordinated with the downward force and the horizontal force to obtain a desired depth of the cutting trench.

Figure 8:
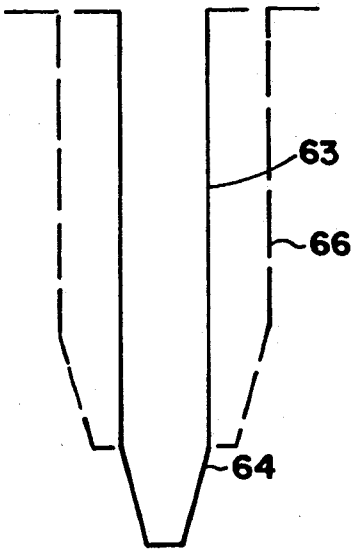
FIG. 8 illustrates a typical cross-sectional profile of a trench.

FIG. 8 shows a typical cut profile of a trench using the cutters of FIG. 6 after many cuts. The solid lines 63 and 64 show the cut profile for the primary cutter. It is noted that the portion of the profile indicated by the numeral 64 is arrow shaped. If one were to use the reaming cutters, then the cut profile would typically take the form of the dotted line 66.

Figure 10:
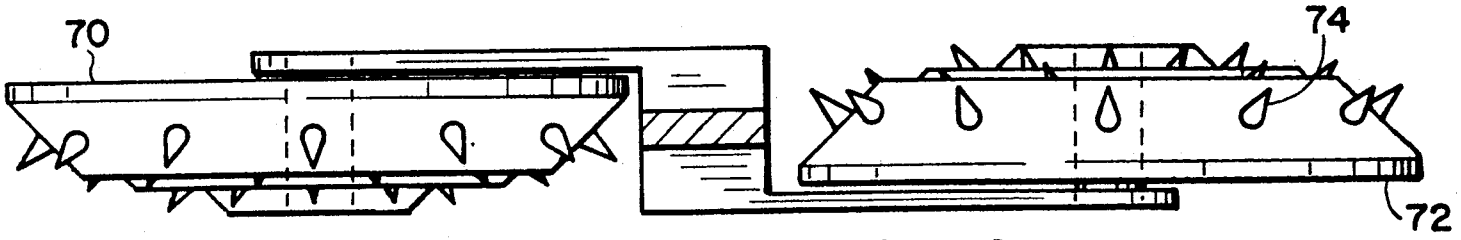
FIG. 10 is a top view of the device of FIG. 9.
Figure 9:
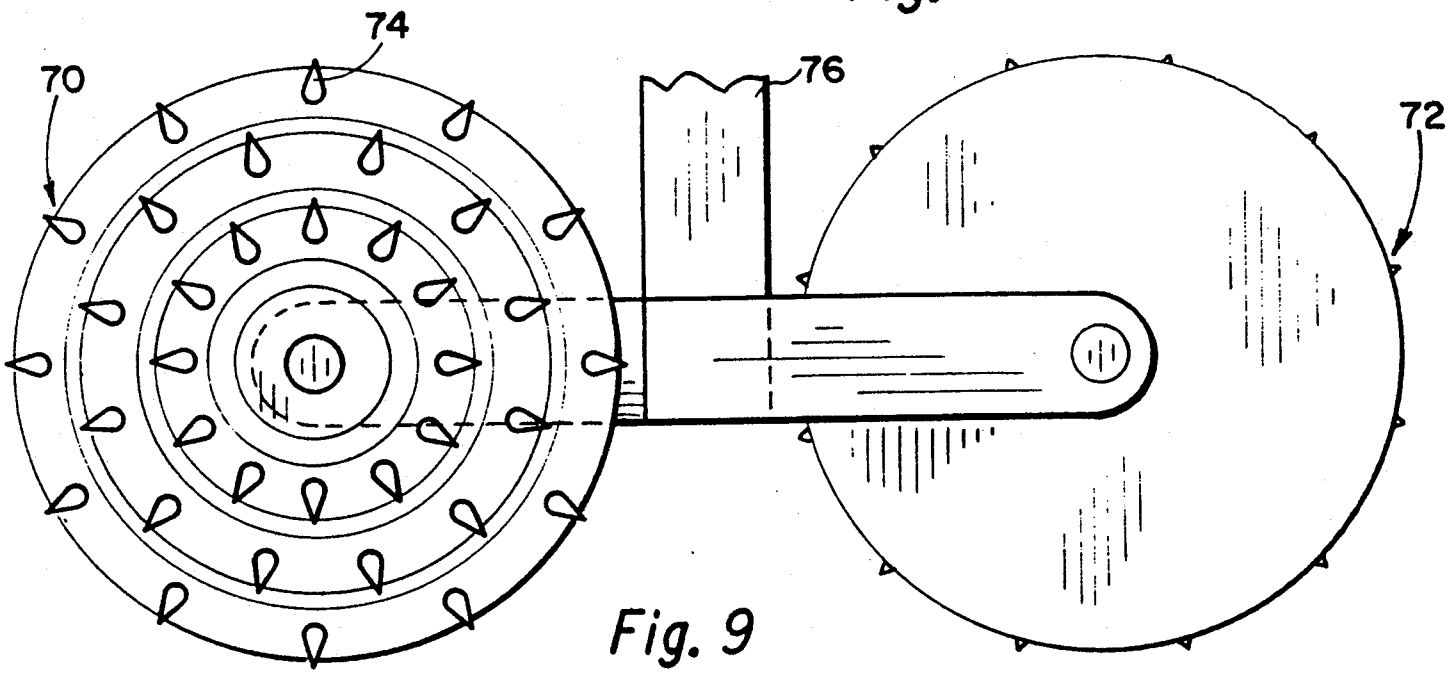
FIG. 9 illustrates a modification of the cutter of FIG. 2 in which the cutter has been sliced in two, with one half spaced in front of the other.

Attention is next directed to FIGS. 9 and 10 which show a modification of the primary cutter. Shown thereon is a cutter, such as shown in FIG. 2, that has been sliced in two. The primary cutter basic section 48 has been sliced in two, forming one-half primary cutter 70 and one-half primary cutter 72. The indexing of the teeth 74 on section 70 would be as the indexing was on the device of FIG. 2 and the indexing on section 72 is independent of the indexing on section 70 but would be in accordance with the principles set forth in regard to FIG. 2. These would be supported by arms 76 from the middle of attachment plate 26A and would be attached to frame 10. This is of some value when really large diameter cutter wheels are used.

Figure 11:
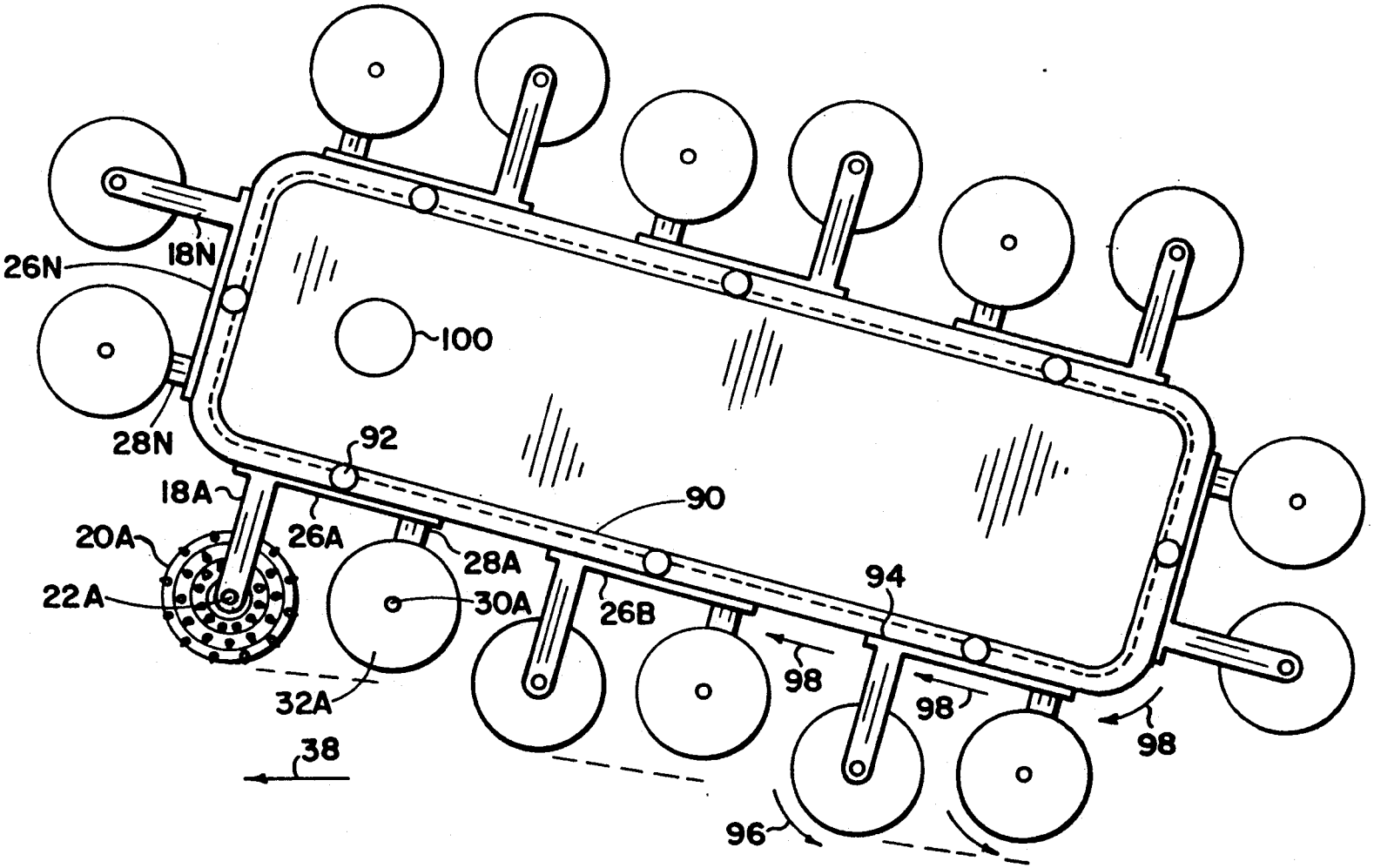
FIG. 11 illustrates another embodiment in which the primary cutters and the reaming cutters are mounted on a chain or cable that rotates about a frame.

As has been previously mentioned, in one embodiment teeth can be fixed to wheels which are propelled by a chain on a track, as illustrated in FIG. 11. The device of FIG. 11 uses the same primary cutter 20A connected to arms 18A to attachment plate 26A and reaming cutter 31A connected by arms 28A to attachment plate 26A. Attachment plate 26A is attached to a chain 94 which is supported from roller track 90 by rollers 92. Rollers 92 are pulled by a chain or cable or the like. The individual cutters will rotate as indicated by arrows 96 as roller track 90 is moved in the direction of travel as indicated by arrow 38. The direction of movement of chain 94 is indicated by arrow 98. Chain 94 may be driven by a pivot point and drive socket, indicated by numeral 100, so that the chain moves in the proper direction 98 at a controlled speed. The entire assembly may be supported by any means which would support the roller track and move it in the direction of travel as indicated by arrow 38, such as by a tractor with controlled hydraulic arms to put the proper force on the cutters.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A machine for cutting a trench in rock which comprises:

a frame having a horizontal axis about which the periphery of the frame may rotate;

means to rotate said frame about said axis;

a plurality of primary cutters spaced about the periphery of said frame;

a support arm for each said primary cutter, each said primary cutter is rotatably supported from its respective support arm such that the axis of said primary cutter is parallel to the axis of said horizontal axis, each said arm being fixed to the periphery of said frame;

each said primary cutter having a disc-like body member having a plurality of spaced apart indentors secured to the external surface thereof, each indentor having an end point, the indentors being adaptable to penetrate into the rock face upon application of working force a distance "P" and wherein said indentor end points are spaced a distance not greater than 7P apart; and a reaming cutter positioned between each pair of said primary cutters, a support arm supporting said reaming cutters from the periphery of said frame, said reaming cutters being rotatably mounted on said arm such that the shaft of rotation is parallel to the shaft of rotation of the primary cutters.

2. A machine as defined in claim 1 in which each said reaming cutter has two-part identical body members, each part having a major rim and at least a minor rim, each said body member having a separate plurality of spaced apart indentors secured to the external surface of each of said rim of said body part, each indentor having an end point, the indentors being of a character to penetrate into the rock face upon the application of working force a distance "P", and wherein said indentor end points are spaced a distance not greater than 7P apart from each other of the indentors on that particular body portion.

3. A machine as defined in claim 2 including means to drive the frame horizontally.

4. A machine as defined in claim 1 in which said support arms of said reaming cutters are essentially the same length as said support arms of said primary cutters.

5. A machine as defined in claim 1 including scrapers supported from said frame adjacent to each said reaming cutter.

6. A machine for cutting a trench in rock which comprises:

a frame;

an endless track supported by said frame;

a moving member supported for movement around said track;

means to drive said moving member along said track;

a plurality of primary cutter arms supported from said moveable member; and a primary cutter rotatably mounted from each said arm, each said cutter having a plurality of spaced apart indentors secured to the external surface thereof, each indentor having an end point, the indentors being adaptable to penetrate into the rock face upon the application of working force a distance "P" and wherein said indentor end points are spaced a distance not great then 7 P apart.

7. An apparatus as defined in claim 6 including a reaming cutter following each said primary cutter, each said reaming cutter having a greater thickness than said primary cutter, each said reaming cutter having a plurality of spaced apart indentors secured to the external surface thereof, each indentor having an end point, the indentors being adapted to penetrate into the rock face upon the application of working force at a distance P and wherein said indentor end points are spaced a distance not greater than 7P apart.

8. An apparatus for cutting a trench in hard rock which comprises:

a frame having a central axis;

a shaft about which said frame is rotatably supported;

means to rotate said frame about said shaft;

a plurality of primary cutter elements;

a support arm for each said primary cutting elements supporting said element from said frame, each of said support arms having a shaft upon which each said primary cutter is mounted;

each of said cutters having a plurality of spaced apart indentors secured to the external surface thereof;

a plurality of reaming cutters, there being one for each said primary cutter;

a support arm for supporting each of said cutter from said frame, each of said reaming cutter support arms having a shaft upon which said reaming cutter is mounted; and each of said reaming cutters having at least two portions, each portion having a plurality of spaced apart indentors secured to the external surface of each of said portion.

9. An apparatus as defined in claim 8 including a plurality of scrapers supported from and positioned about the periphery of said frame.

10. A machine for cutting a trench in rock comprising:

a support member including a first shaft;

primary cutting member having a disc-like integral body member having a major rim and at least one minor rim, said major and minor rims being essentially circular and having a common axis, said body member being rotatably mounted on said shaft at said common axis;

a plurality of spaced apart indentors secured to the external surface of each said rim, each indentor having an end point, the indentor being adaptable to penetrate into the rock face upon the application of working force a distance "P" and wherein said indentor end points are spaced a distance not greater than seven times the depth of penetration (7P) apart;

means to move said support member;

a reaming cutter supported from said support means on a shaft having an axis parallel to said first shaft, said reaming cutter having at least a major and a minor rim, said second body member of said reaming cutter being of a greater width than that of said body of said cutter; and a plurality of spaced apart indentors secured to the external surface of said major and said minor rims of said reaming cutters, each indentor having an end point, the indentor being adaptable to penetrate into a rock face upon the application of work in force at distance P, wherein said indentor end points are spaced a distance of not greater than 7P apart.

11. A machine as defined in claim 10 in which said shafts are supported by arm members of approximately the same length.

12. A machine as defined in claim 11 in which said support arms supporting said shafts are of different lengths.

13. A machine according to claim 10 wherein the machine includes means for applying a force for moving the machine in a selected direction of trenching and the apparatus is configured to obtain a rock face in operation and wherein;

each said indentor is substantially conically shaped on its outer surface and wherein the included conical angle is between 40 to 60 degrees;

the slope of the rock face relative to the direction of drilling is between 60 to 90 degrees;

the attack angle between each indentor conical surface in said rock face is between 45 to 90 degrees; and the relief angle between the conical surface and of each indentor in a plane perpendicular to the direction of drilling is between 25 to 45 degrees.

14. A machine as defined in claim 10 in which said reaming cutter has:

two spaced apart essentially identical reaming body portions, each body having a major rim, a minor rim and an intermediate rim with a planar surface;

each of said body portions being rotatably mounted upon said second shaft, the exterior of said minor rims being spaced a distance apart greater than the thickness of said cutting member.

15. A machine as defined in claim 14 including a plurality of indentors on each said major rim and each said minor rim of said two reaming body portions, on each body the spaced apart indentors are secured to the external surface thereof, each indentor having an end point, the indentors being adaptable to penetrating into the rock face upon the application of working force a distance "P" and wherein said indentor end points are spaced a distance of not greater than 7P apart.

* * * * *